US006906740B2

(12) United States Patent
Suto et al.

(10) Patent No.: US 6,906,740 B2
(45) Date of Patent: Jun. 14, 2005

(54) LIGHT EMITTING ARRAY UNIT AND SIDE PRINTING DEVICE

(75) Inventors: Akio Suto, Kanagawa (JP); Masayuki Shimizu, Kanagawa (JP)

(73) Assignee: Fuji Photo Film., Ltd., Kanagawa (JP)

( * ) Notice: Subject to any disclaimer, the term of this patent is extended or adjusted under 35 U.S.C. 154(b) by 27 days.

(21) Appl. No.: 10/279,826

(22) Filed: Oct. 25, 2002

(65) Prior Publication Data

US 2003/0081107 A1 May 1, 2003

(30) Foreign Application Priority Data

Oct. 29, 2001 (JP) ..... 2001-330821

(51) Int. Cl.[7] ..... B41J 27/00
(52) U.S. Cl. ..... 347/244; 347/258
(58) Field of Search ..... 347/238, 241–244, 347/256–258, 262, 130, 134; 358/511; 359/211; 385/36; 353/33; 257/88; 430/496; 396/549

(56) References Cited

U.S. PATENT DOCUMENTS 3,827,062 A * 7/1974 Mailloux ..... 396/549
4,508,438 A 4/1985 Kanaoka et al.
5,084,714 A * 1/1992 Beaman et al. ..... 347/244
5,258,629 A * 11/1993 Itoh et al. ..... 257/88
5,885,759 A * 3/1999 Nakamura ..... 430/496
6,295,080 B1 * 9/2001 Deguchi et al. ..... 347/262
2002/0033876 A1 3/2002 Shimizu et al.

FOREIGN PATENT DOCUMENTS

JP 2-100043 4/1990

* cited by examiner

*Primary Examiner*—Hai Pham
(74) *Attorney, Agent, or Firm*—Sughrue Mion, PLLC

(57) ABSTRACT

A light emitting array unit for emitting line-shaped light is provided. A first light emitting element array includes a first group of plural light emitting elements, for emitting a first train of spotted lights. A second light emitting element array is disposed to extend substantially in parallel with the first light emitting element array, and includes a second group of plural light emitting elements arranged alternately with the plural light emitting elements in the first group, for emitting a second train of spotted lights. A first prism element group receives incidence of the first spotted light train, and emits the first spotted light train in a predetermined direction. A second prism element group receives incidence of the second spotted light train, and emits the second spotted light train in the predetermined direction. The line-shaped light is constituted by the first and second spotted light trains and is emitted.

15 Claims, 8 Drawing Sheets

LIGHT EMITTING ARRAY UNIT AND SIDE PRINTING DEVICE

BACKGROUND OF THE INVENTION

1. Field of the Invention

The present invention relates to a light emitting array unit having light emitting elements, and a side printing device. More particularly, the present invention relates to a light emitting array unit having light emitting elements, and a side printing device, which have a simple structure and in which quality in emitting light can be high.

2. Description Related to the Prior Art

A process of manufacturing photosensitive material, such as photo film, includes a step of side printing for printing information to a side portion of the photosensitive material in a form of a latent image. The information has forms of at least one of letters, numbers, indicia, bar code or the like, and represents a name of the manufacturer, the ISO sensitivity and the like. The latent image is converted to a visible image by developing operation for developing the photosensitive material. At the time of producing photographic prints, the information can be read or checked directly by the naked eye of an operator, or an automatic reader device.

JP-A 2-100043 discloses an example of side printing head assembly for side printing to a side portion of the photosensitive material. The side printing head assembly includes a light source, which includes plural LEDs (light emitting diodes) for emitting light of different wavelengths. Optical fibers having a great diameter include an entrance surface, which is opposed to the light source. A plurality of optical fiber bundles having a small diameter is connected to an exit surface of the optical fibers by fiber coupling. Light from the light source is caused to exit through the exit surfaces of the optical fiber bundles.

The optical fibers mix up uniformly the colors of light emitted by the LEDs as light source. The optical fiber bundles form shapes of pixels. Exit surfaces of the optical fiber bundles are oriented perpendicularly to feeding of the photosensitive material. In synchronism with feeding of the photosensitive material, the LEDs are driven to emit light selectively. The latent image of the letters, numbers, indicia, bar code or the like is printed to a side portion of the photosensitive material through a lens constituting an optical system for the side reduction.

Also, U.S. Pat. No. 4,508,438 (corresponding to JP-A 58-219543) discloses another structure of the side printing head assembly. An LED array includes plural LEDs, is opposed to the photosensitive material, and extends perpendicularly to feeding of the photosensitive material. Each of the LEDs in the LED array corresponds to one of the pixels constituting the latent image, and is connected with an LED driver, and is driven selectively to illuminate according to a pixel position designated in the sequential driving. A pattern is created by sequential driving, and is focused on to the side portion of the photosensitive material by a lens that is an optical system for size reduction. In synchronism with feeding of the photosensitive material, the LEDs are selectively driven one after another, to print the latent image of the letters, numbers, indicia, bar code or the like to the side portion of the photosensitive material.

However, the known structure according to the above first document has a shortcoming. The side printing head assembly including the optical fibers has such problems as diminution of the light amount in the optical fiber bundles, a considerably large space of the entire apparatus due to the structural complexity, a high manufacturing cost, and the like.

On the other hand, the known structure according to the above second document has a shortcoming. Light beams emitted by adjacent two of the LEDs are mixed at least partially, to cause problems of irregularity in the light amounts between the pixels, irregularity in patterned dots, and other unwanted states of light. Also, the LEDs must be disposed in a very high number per unit area, and causes difficulties in producing a wiring pattern on a printed circuit board. It may be possible to prevent such problems by spreading an interval at which the LEDs are arranged. However, a pitch of pixels in the latent image will be greater, so that the quality in printing will become remarkably low.

SUMMARY OF THE INVENTION

In view of the foregoing problems, an object of the present invention is to provide a light emitting array unit having light emitting elements, and a side printing device, in which quality in emitting light can be high, which can be produced easily, and also in which the light emission can be controlled easily.

In order to achieve the above and other objects and advantages of this invention, a light emitting array unit for emitting line-shaped light constituted by plural spotted lights arranged in a line is provided. There are N light emitting element arrays disposed substantially in parallel with one another, each of the light emitting element arrays including plural light emitting elements arranged linearly in a first direction and at a pitch P, the light emitting elements being offset between the light emitting element arrays in the first direction by P/N time as much an amount as the pitch. A light guide means guides light emitted by respectively the light emitting elements, to create the line-shaped light.

A light emitting array unit for emitting line-shaped light is provided, in which a first light emitting element array includes first to Pth light emitting elements, for emitting a first beam train or train of spotted lights. A second light emitting element array is disposed to extend substantially in parallel with the first light emitting element array, and includes (P+1)th to Qth light emitting elements arranged alternately with the first to Pth light emitting elements for emitting a second beam train. At least one light path changer receives incidence of a selected one of the first and second beam trains, and changes a path of the selected beam train to emit the selected beam train together with a remaining one of the first and second beam trains, the line-shaped light being constituted by the first and second beam trains and being emitted.

In a preferred embodiment, the at least one light path changer includes a first light path changer for receiving incidence of the first beam train, and for emitting the first beam train in a predetermined direction. A second light path changer receives incidence of the second beam train, and emits the second beam train in the predetermined direction.

The line-shaped light is projected to photosensitive material being fed, and prints information thereon.

The first light path changer includes first to Pth reflection surfaces for reflecting first to Pth beams or spotted lights in a predetermined direction, the first to Pth beams being included in the first beam train being incident. The second light path changer includes (P+1)th to Qth reflection surfaces for reflecting (P+1)th to Qth beams in the predetermined direction, the (P+1)th to Qth beams being included in the second beam train being incident.

Furthermore, first to Pth photo sensors detect respectively the first to Pth beams or spotted lights, to check operation of the first to Pth light emitting elements. (P+1)th to Qth photo sensors detect respectively the (P+1)th to Qth beams, to check operation of the (P+1)th to Qth light emitting elements.

The first and second light path changers include first to Qth prism elements having respectively the first to Qth reflection surfaces.

The first to Pth light emitting elements and the (P+1)th to Qth light emitting elements are so arranged that an interval between two adjacent light emitting elements thereof are substantially equal to a width of each of the light emitting elements.

An Nth reflection surface included in the first to Qth reflection surfaces reflects part of an Nth beam or spotted beam included in the first to Qth beams, and transmits remaining part of the Nth beam. An Nth photo sensor included in the first to Qth photo sensors is disposed on an extension of a straight line from an Nth light emitting element included in the first to Qth light emitting elements to the Nth reflection surface.

The first to Qth light emitting elements are light emitting diodes.

The photosensitive material is photo film, and the information is printed to a side portion of the photo film.

The first and second light emitting element arrays are opposed to each other, and emit the first and second beam trains toward each other. The first and second light path changers are disposed between the first and second light emitting arrays, and the predetermined direction is crosswise to a straight line extending between the first and second light emitting element arrays.

The (P+1)th to Qth reflection surfaces are arranged alternately with the first to Pth reflection surfaces, and are inclined opposite to the first to Pth reflection surfaces.

Furthermore, first and second boards have respectively the first and second light emitting element arrays mounted thereon, and being so disposed that the first and second light path changers are disposed therebetween.

In another preferred embodiment, furthermore, one board is provided, and has the first and second light emitting element arrays mounted thereon. The first to Pth light emitting elements and the (P+1)th to Qth light emitting elements are arranged in a zigzag arranging form.

The first to Pth reflection surfaces and the (P+1)th to Qth reflection surfaces are arranged in a zigzag form defined by moving the zigzag arranging form in parallel.

In still another preferred embodiment, each of the first to Qth light emitting elements includes three light emitting diodes for emitting light of respectively red, green and blue colors.

In another preferred embodiment, the light emitting array unit is used as a combination of first, second and third light emitting array units for emitting light of respectively red, green and blue colors.

According to another aspect of the invention, a side printing device is provided. A red light emitting array unit emits line-shaped light constituted by plural red spotted lights arranged in a line. A green light emitting array unit emits line-shaped light constituted by plural green spotted lights arranged in a line. A blue light emitting array unit emits line-shaped light constituted by plural blue spotted lights arranged in a line. An optical system combines the line-shaped light of three colors, to record a letter, number or indicia photographically in a full-color manner to a side portion of photo film being fed. Each of the red, green and blue light emitting array units includes the above-described construction.

The optical system includes two dichroic mirrors for combining the line-shaped light of the three colors, and a lens for projecting the line-shaped light of the three colors being combined on to the photo film.

In another preferred embodiment, the optical system includes three lenses for projecting respectively the line-shaped light of the three colors, to combine the three colors of the line-shaped light on to the photo film.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
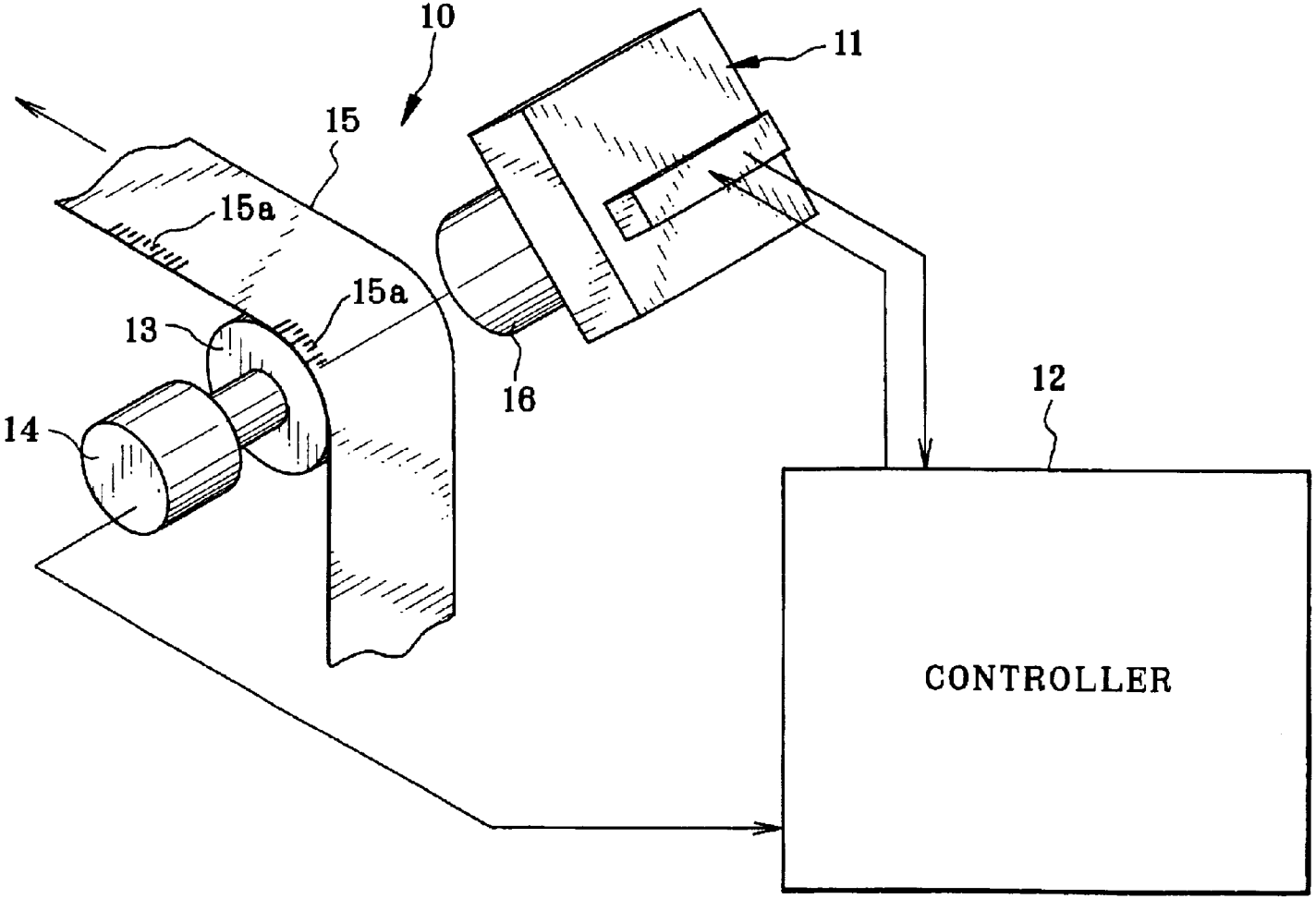
FIG. 1 is a perspective, partially cutaway, illustrating a side printing device.

In FIG. 1, a side printing device 10 is depicted. The side printing device 10 includes a printing head 11, a controller 12, a suction drum 13, a rotary encoder 14 and the like. Photo film 15 as a photosensitive material is positioned, and opposed to the printing head 11. The printing head 11 includes a lens 16 and a light emitting array unit 18. The lens 16 is an optical system for reduction of an image size. In the light emitting array unit 18 are disposed exit surfaces 17 arranged in an array for outputting light. See FIG. 2.

The light emitting array unit 18 outputs light through the exit surfaces 17 for forming a latent image 15*a* of information by projecting the light into a side portion of the photo film 15, in such desired forms as letters, numbers, indicia, bar code or the like. The emitted light is passed through the lens 16, and projected to the side portion of the photo film 15 for an exposure. Each one of the exit surfaces 17 is associated with one pixel in the latent image 15*a* of the photo film 15. The light in the line shape is emitted by the light emitting array unit 18 to print one line of the latent image 15*a*.

The photo film 15 is fed by the suction drum 13 which tightly contacts the photo film 15 by suction. The rotary encoder 14 is connected with the suction drum 13, and detects a state of feeding the photo film 15. Each time that the photo film 15 is fed by a predetermined length, one rotational pulse is generated by the rotary encoder 14. The rotational pulse is sent to the controller 12, which drives the light emitting array unit 18 in synchronism with feeding of the photo film 15. The latent image 15*a* is recorded to the photo film 15 one line after another.

Figure 3:
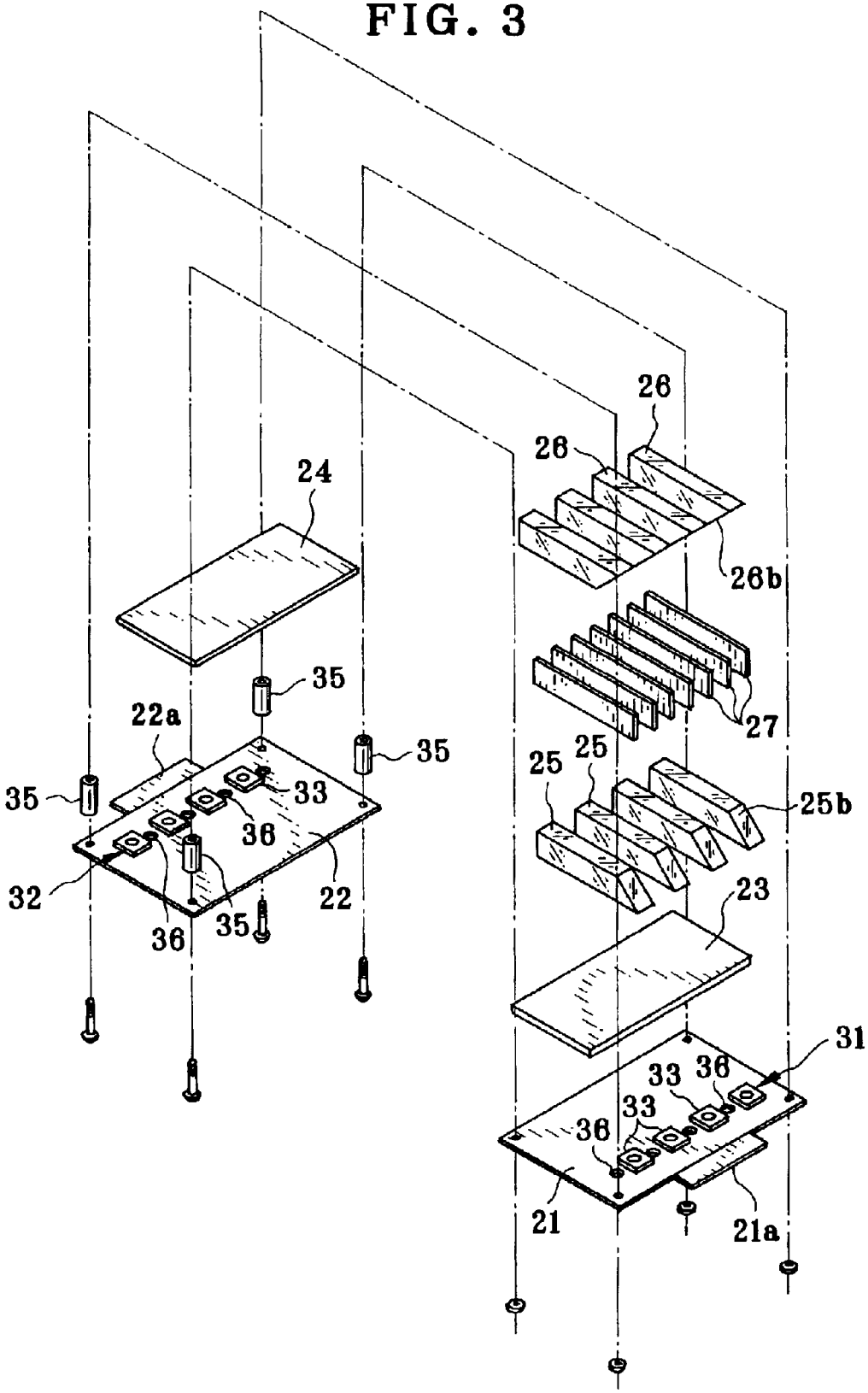
FIG. 3 is an exploded perspective illustrating the light emitting array unit.

In FIG. 3, the light emitting array unit 18 includes light emitting array boards 21 and 22, spacer sheets 23 and 24, a first prism element group 25 as first light path changer, a second prism element group 26 as second light path changer, and opaque blocking partitions 27. A first light emitting element array 31 is mounted on the light emitting array board 21. A second light emitting element array 32 is mounted on the light emitting array board 22.

Figure 4:
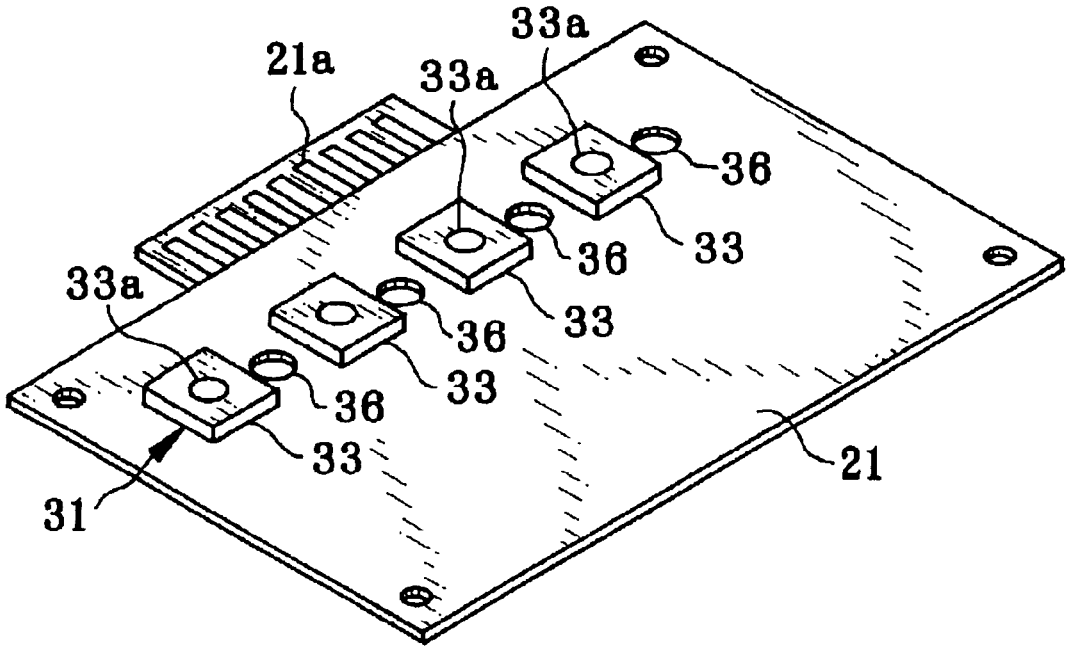
FIG. 4 is a perspective illustrating light emitting array boards in the light emitting array unit.

In FIG. 4, chips of LEDs (light emitting diodes) 33 as light emitting elements are arranged on the light emitting array board 21 in an array extending perpendicularly to feeding of the photo film 15, and constitute the first light emitting element array 31. Each of the LEDs 33 includes an illuminating surface 33*a* for emitting a light beam or spotted light. An interval between the LEDs 33 in the first light emitting element array 31 is approximately equal to a size of each of the LEDs 33. An array of terminals 21*a* is provided, and operates for connection with the controller 12. The terminal array 21*a* connects the LEDs 33 to the controller 12 electrically.

The second light emitting element array 32 in the light emitting array board 22 includes the LEDs 33 in a manner similar to the first light emitting element array 31. There is an array of terminals 22*a* in the light emitting array board 22 for connecting the LEDs 33 with the controller 12 electrically. The light emitting array board 22 is structurally equal to the light emitting array board 21, so that the two boards of only one type are prepared for the purpose of producing the light emitting array unit 18.

The light emitting array boards 21 and 22 are so oriented as to oppose the LEDs 33 to one another on the two arrays. There are spacer sleeves 35 through which screws are inserted. The screws fasten the light emitting array board 21 to the light emitting array board 22 at a predetermined interval. Arrangement of the LEDs 33 is so determined that the LEDs 33 of a first one of the boards are not opposed to the LEDs 33 of the second one of the boards when boards are fastened on each other.

In combining the light emitting array boards 21 and 22, the LEDs 33 included in the second light emitting element array 32 are disposed in alternation with those in the first light emitting element array 31. In other words, the LEDs 33 in the second light emitting element array 32 are offset from those in the first light emitting element array 31 by an amount equal to the width of the LEDs 33. Detection openings 36 are formed in the light emitting array boards 21 and 22 and positioned in their portions respectively opposed to the LEDs 33.

In the present embodiment, the arrangement of the LEDs 33 is predetermined so that the contours of the light emitting array boards 21 and 22, when combined, are opposed exactly to each other without offsetting. However, it may be possible to shape the light emitting array boards 21 and 22 so that the LEDs 33 would opposed directly to one another between those if those were opposed exactly. At the time of combining, the light emitting array boards 21 and 22 are intentionally offset by an amount of one LED so that the LEDs 33 are offset in the array extending direction.

The LEDs 33 in the single light emitting array unit have one common color. If the light emitting array unit is for use with motion picture photo film of a color positive type, the LEDs 33 have one of green and blue colors because red is used for the sound track. If the light emitting array unit is for use with motion picture photo film of a color negative type or photo film for still photography, the LEDs 33 have one of orange and yellow colors. If the light emitting array unit is for use with X-ray photo film, the LEDs 33 have one of green and blue colors.

Figure 5:
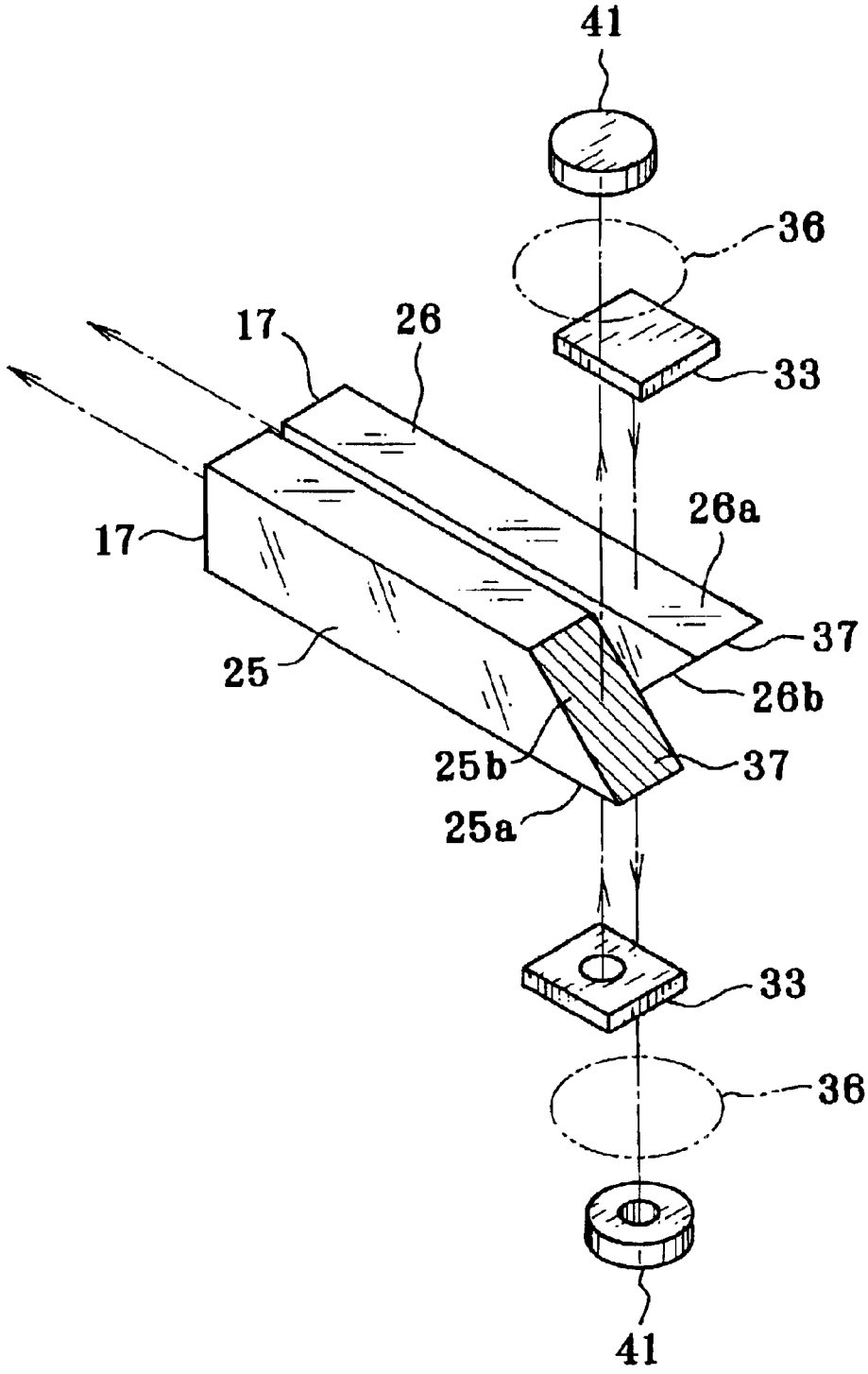
FIG. 5 is an exploded perspective illustrating arrangement of LEDs, prism elements and photo sensors.

In FIG. 5, the first and second prism element groups 25 and 26 are right-angle prisms in which entrance surfaces 25*a* and 26*a* receive entry of light, and the exit surfaces 17 output the light after bending a light path of the light by 90 degrees. The second prism element group 26 is structurally the same as the first prism element group 25 except for an orientation in disposition.

The first prism element group 25 includes plural prism elements corresponding to the LEDs 33 in the first light emitting element array 31. The entrance surface 25*a* is opposed to the illuminating surface 33*a* of the LEDs 33 in the first light emitting element array 31. The first prism element group 25 is oriented to direct the exit surfaces 17 to the front of the light emitting array unit 18. The second prism element group 26 includes plural prism elements corresponding to the LEDs 33 in the second light emitting element array 32. The entrance surface 26*a* is opposed to the illuminating surface 33*a* of the LEDs 33 in the second light emitting element array 32. The second prism element group 26 is oriented to direct the exit surfaces 17 to the front of the light emitting array unit 18.

Inclined reflection surfaces 25*b* and 26*b* are included in the first and second prism element groups 25 and 26 for bending light paths of the light beams or spotted lights. The light emitted by the LEDs 33 of the first and second light emitting element arrays 31 and 32 is bent by the inner reflection surfaces 25*b* and 26*b*, and exits through the exit surfaces 17. As the exit surfaces 17 are aligned in the combination of the first and second prism element groups 25 and 26, beams of the light or spotted lights from the LEDs 33 are output through the front of the light emitting array unit 18 in a regularly aligned manner.

The exit surfaces 17 of the first and second prism element groups 25 and 26 have a sufficient surface roughness in a form of frosted glass to diffuse the light being emitted to the outside. This regulates an amount of light output for each of the pixels by the LEDs 33 as light source.

Half mirrors 37 are formed by depositing aluminum or the like on the reflection surfaces 25*b* and 26*b* of the first and second prism element groups 25 and 26. The light from the LEDs 33 strikes the entrance surfaces 25*a* and 26*a* for entry, and is reflected by the inside of the reflection surfaces 25*b* and 26*b*. However, the LEDs 33 are disposed very close to the entrance surfaces 25*a* and 26*a*. An angle of incidence of the light from the LEDs 33 relative to the reflection surfaces 25*b* and 26*b* is in a considerably large range. Therefore, no total reflection of the incident light occurs. Part of the incident light passes the reflection surfaces 25*b* and 26*b*, and exits from those. The remaining part is reflected by the reflection surfaces 25*b* and 26*b* in a manner of partial reflection.

The reflection layer is formed on the reflection surfaces 25*b* and 26*b*, which is effective in minimizing a loss of light. Through the reflection layer or the half mirrors 37, part of the incident light is used for checking operation of the LEDs 33.

The blocking partitions 27 are arranged between the first and second prism element groups 25 and 26. Light emitted by any one selected among the prism elements is prevented by the blocking partitions 27 from entry into the remaining prism elements. This is effective in preventing occurrence in irregularity in the light amounts between the pixels, irregularity in patterned dots, and other unwanted states of light. In FIG. 3, the blocking partitions 27 are depicted with a greater thickness than it has actually for the purpose of understanding by exaggeration. An actual thickness of the blocking partitions 27 is approximately 2 $\mu$m. Alternatively, it is possible to form a light-shielding film or layer by aluminum deposition on lateral faces of the first and second prism element groups 25 and 26 instead of disposing the blocking partitions 27.

The spacer sheets 23 and 24 have suitably high resiliency, and are disposed between the inner face of the light emitting array board 21 and the first prism element group 25 and the inner face of the light emitting array board 22 and the second prism element group 26. The spacer sheet 23 has a thickness associated with a difference between levels of the light emitting array board 21 and the LEDs 33 in a space between the light emitting array board 21 and the first prism element group 25. The spacer sheet 24 has a thickness associated with a difference between levels of the light emitting array board 22 and the LEDs 33 in a space between the light emitting array board 22 and the second prism element group 26.

The spacer sheets 23 and 24 have a compressible characteristic, and when the light emitting array boards 21 and 22 are combined, are resiliently deformed by pressure of the light emitting array boards 21 and 22 and the prisms. The spacer sheets 23 and 24 contact those tightly, and keep the prisms positioned relative to the array boards. In the present embodiment, both of the spacer sheets 23 and 24 are resilient and compressible. However, only a selected one of the spacer sheets 23 and 24 may be compressible. The remaining one of those may be rigid, and may operate only as a spacer without the tight contact.

Figure 2:
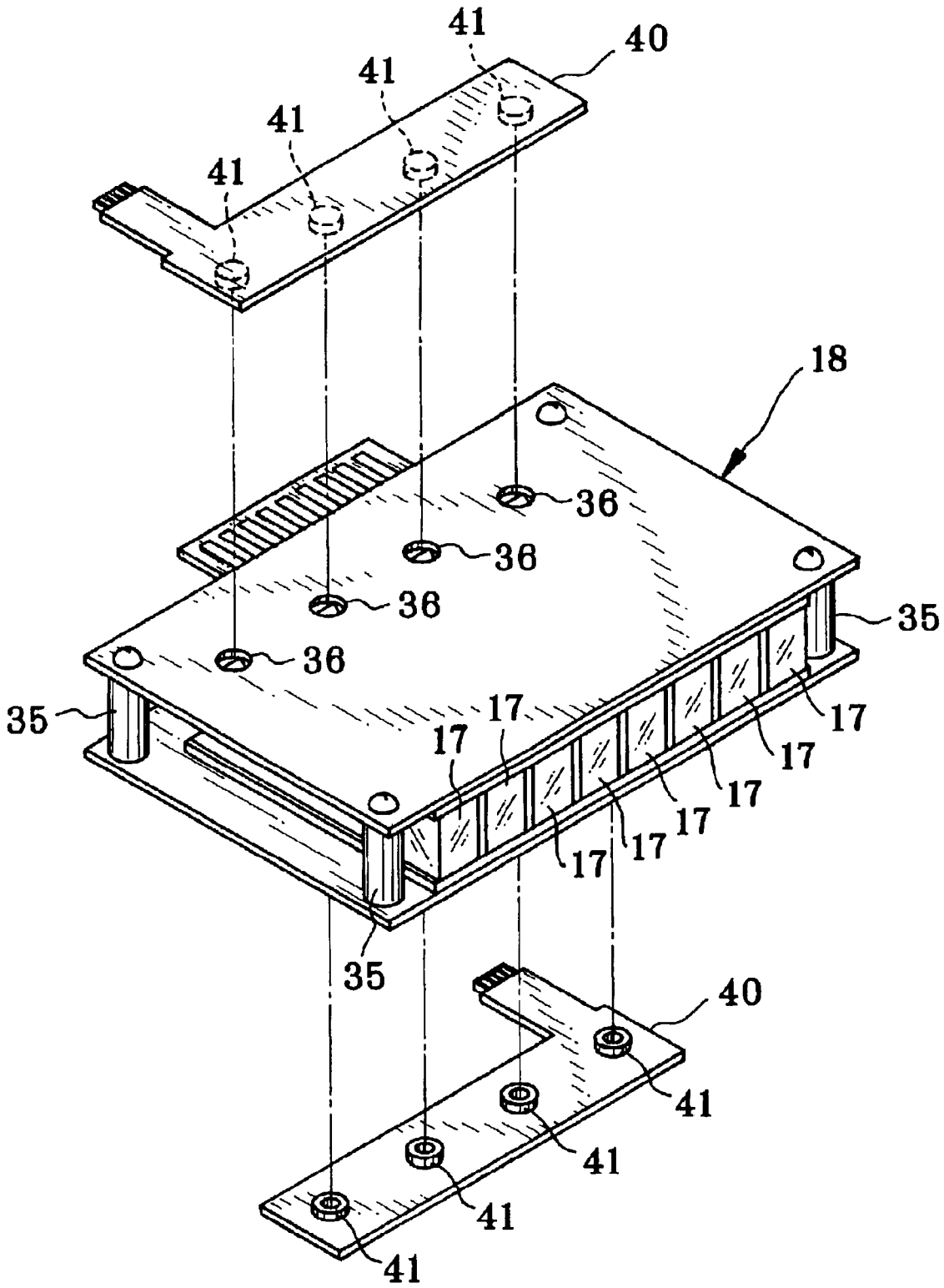
FIG. 2 is an exploded perspective illustrating a light emitting array unit in the side printing device according to the invention.

In FIG. 5, the reflection surfaces 25*b* and 26*b* of the first and second prism element groups 25 and 26 are disposed directly above or below the detection openings 36 formed in the light emitting array boards 21 and 22. In FIG. 2, a detection circuit board 40 is mounted on an outer face of the light emitting array boards 21 and 22. Photo sensors 41 are incorporated in the detection circuit board 40. Examples of the photo sensors 41 are photo diodes, photo transistors and the like. The photo sensors 41 are positioned on light paths that pass the detection openings 36 and the reflection surfaces 25*b* and 26*b*, as the detection circuit board 40 is mounted on each of the light emitting array boards 21 and 22.

The photo sensors 41 output a photoelectric signal upon receiving light. The photoelectric signal is sent from the photo sensors 41 to the controller 12. The controller 12 monitors the photoelectric signal, and checks whether the LEDs 33 normally emits light. It is to be noted that the LEDs 33 may be inspected as to whether light is output at an intended light amount. Feedback control may be used to adjust the LEDs 33 to emit at a regularized light amount.

An input device (not shown) is connected with the controller 12. Information related to printing is input to the controller 12 by operating the input device. According to the input information, the controller 12 drives the LEDs 33 selectively to emit light beams or spotted lights, so as to record the information to the photo film 15 in a form of the latent image 15*a*. A current of driving the LEDs 33 and time of light emission are determined suitably according to photosensitivity and feeding speed of the photo film 15.

The operation of the above construction is described now. The controller 12 is supplied with signals of printing information for printing letters, numbers, indicia, bar codes and the like to a side portion of the photo film 15 as the latent image 15*a*. A driving pattern to drive the LEDs 33 is produced in the controller 12 according to the printing information.

Then a command signal for starting the side printing device 10 is input. The photo film 15 starts being fed. The rotary encoder 14 outputs a rotational pulse and sends the same to the controller 12. The controller 12 drives the LEDs 33 selectively in synchronism with feeding of the photo film 15 according to a patterned sequence for driving the LEDs 33 and the rotational pulse.

Light beams or spotted lights emitted by the LEDs 33 on the light emitting array board 21 enter the first prism element group 25 through the entrance surface 25*a*, and are reflected by the reflection surface 25*b*, and exit from the first prism element group 25 through the exit surfaces 17. Light beams emitted by the LEDs 33 on the light emitting array board 22 enter the second prism element group 26 through the entrance surface 26*a*, and are reflected by the reflection surfaces 26*b*, and exit from the second prism element group 26 through the exit surfaces 17.

As a result, light emitted by the LEDs 33 on the light emitting array boards 21 and 22 exits through the exit surfaces 17 aligned in the front of the light emitting array unit 18, passes through the lens 16, and is projected to the photo film 15 for an exposure in one line. In synchronism with feeding of the photo film 15, the LEDs 33 are selectively driven, to record information or the latent image 15*a* by projecting beams or spotted lights in an array to the side portion of the photo film 15 one line after another.

The exit surfaces 17 are formed in the manner of frosted glass. This form diffuses the light beams or spotted lights exiting through the exit surfaces 17. Also, the blocking partitions 27 between the first and second prism element groups 25 and 26 operate for blocking light. There occurs no irregularity in the light amounts between the pixels, irregularity in patterned dots, and other unwanted states of light.

While the latent image 15*a* is recorded one line after another, part of light output by the LEDs 33 is passed through the half mirrors 37, and received by the photo sensors 41. If one of the LEDs 33 operates normally, a corresponding one of the photo sensors 41 outputs a photoelectric signal at a predetermined sufficient level. If one of the LEDs 33 is broken and does not emit light, a corresponding one of the photo sensors 41 does not output a photoelectric signal even while the light emitting array unit operates.

The controller 12 checks changes in the photoelectric signal according to timing of driving the LEDs 33, and monitors a normal state of the LEDs 33 emitting light beams. If abnormality is detected to occur, a sequence for recording the latent image 15*a* is discontinued. An abnormality signal is sent to the external interface. Signal processing at the external interface stops the suction drum 13 from being driven. The feeding of the photo film 15 is stopped. If abnormality is detected, no failing product is made any longer. It is easy to designate positions in the photo film 15 having abnormality.

Light paths of light beams or spotted lights emitted by the LEDs 33 are bent by the first and second prism element groups 25 and 26 in a vertical manner, to emit light in a line shape. Then the light emitting array unit 18 can be constructed in a reduced size. Also, it is easy to design a pattern of wiring for driving the LEDs 33, because the LEDs 33 are arranged at a sufficient interval on the light emitting array boards 21 and 22.

The first and second prism element groups 25 and 26 in the light emitting array unit 18 cause the light beams or spotted lights from the LEDs 33 to exit and travel in one array. It is unnecessary to set changes in the timing of driving the LEDs 33 for the purpose of exposing one line. Thus, it is easy to control light emission of the LEDs 33.

Figure 6:
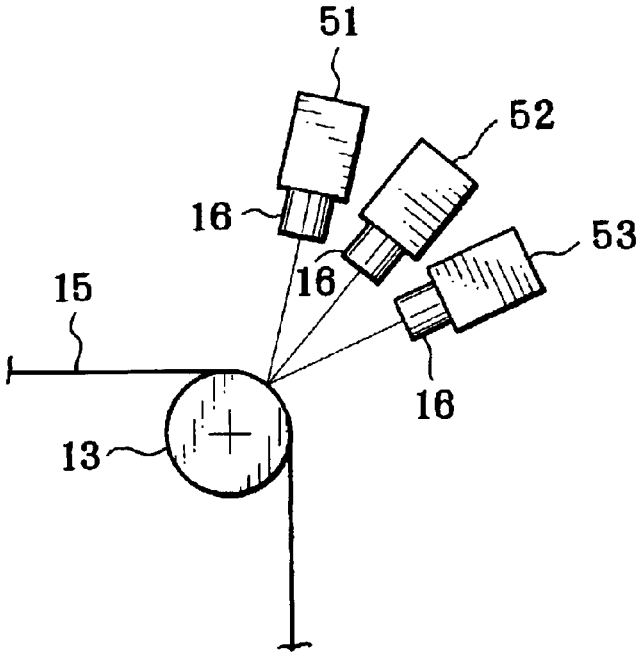
FIG. 6 is an explanatory view in side elevation, illustrating a preferred embodiment in which three printing heads are used for full-color printing.

In FIG. 6, a side printing device of another preferred embodiment is depicted, including a red printing head 51, green printing head 52, and blue printing head 53 each of which is a light emitting array unit. Each of the printing heads 51–53 is provided with the lens 16. To output light of a selected one of three colors from the printing heads 51–53, any suitable one of various methods can be used. For example, LED chips having red, green and blue colors may be used. Alternatively, filters of red, green and blue colors may be combined with LED chips illuminating in a white color.

In this construction, the arrays of the light beams or spotted lights emitted by the printing heads 51–53 are mixed at points on the surface of the photo film 15. The proportion in the light amount between the light beam arrays from the printing heads 51–53 can be changed to form the latent image 15*a* in full-color recording as desired.

Figure 7:
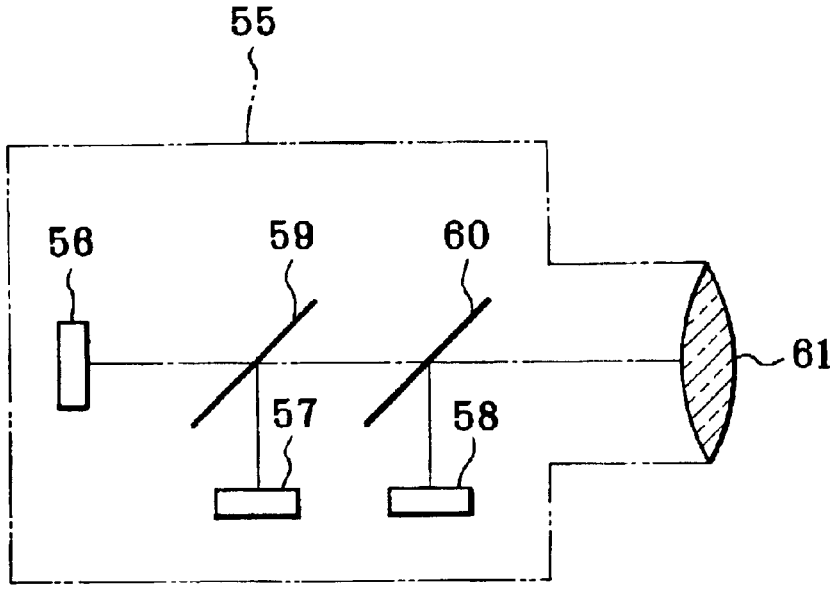
FIG. 7 is an explanatory view illustrating another preferred side printing device having three LED array units for three colors.

In the embodiment of FIG. 6, the colors of light are mixed on the surface of the photo film. However, the colors of light may be mixed in a printing head 55 as depicted in FIG. 7. The printing head 55 includes a red light emitting array unit 56, a green light emitting array unit 57, a blue light emitting array unit 58, dichroic mirrors 59 and 60, and a lens 61. Each of the light emitting array units 56, 57 and 58 includes LEDs arranged in line. The dichroic mirror 59 lets red light pass, and reflects green light. The dichroic mirror 60 lets red light and green light pass, and reflects blue light.

Light axes of the green and blue light emitting array units 57 and 58 for the green and blue colors are set perpendicular to a light axis of the red light emitting array unit 56 for the red color. The dichroic mirror 59 is disposed at an intersection point of the light path of the green light emitting array unit 57 and that of the red light emitting array unit 56. The dichroic mirror 60 is disposed at an intersection point of the light path of the blue light emitting array unit 58 and that of the red light emitting array unit 56. When light beams or spotted lights are output by the light emitting array units 56–58, the red, green and blue colors of the light beams are mixed up in the printing head 55, and projected to the photo film 15 through the lens 61.

It is preferable that part of light emitted by the green and blue light emitting array units 57 and 58 may be received by photo sensors and checked. To this end, pinholes may be formed in the dichroic mirrors 59 and 60 for passing the light. Furthermore, the dichroic mirrors 59 and 60 can have such a characteristic as to pass part of light of the green and blue light emitting array units 57 and 58 in a particular wavelength range. Also, it is possible to add a dichroic mirror for bending a light path of light from the red light emitting array unit 56. This dichroic mirror may be provided with a structure similar to that of the dichroic mirrors 59 and 60, so as to monitor light emission of the LED chips. Note that, in order to bend the red light path, a structure other than the dichroic mirror may be used. For example, a half mirror, a mirror with pinholes or the like may be used.

Figure 8:
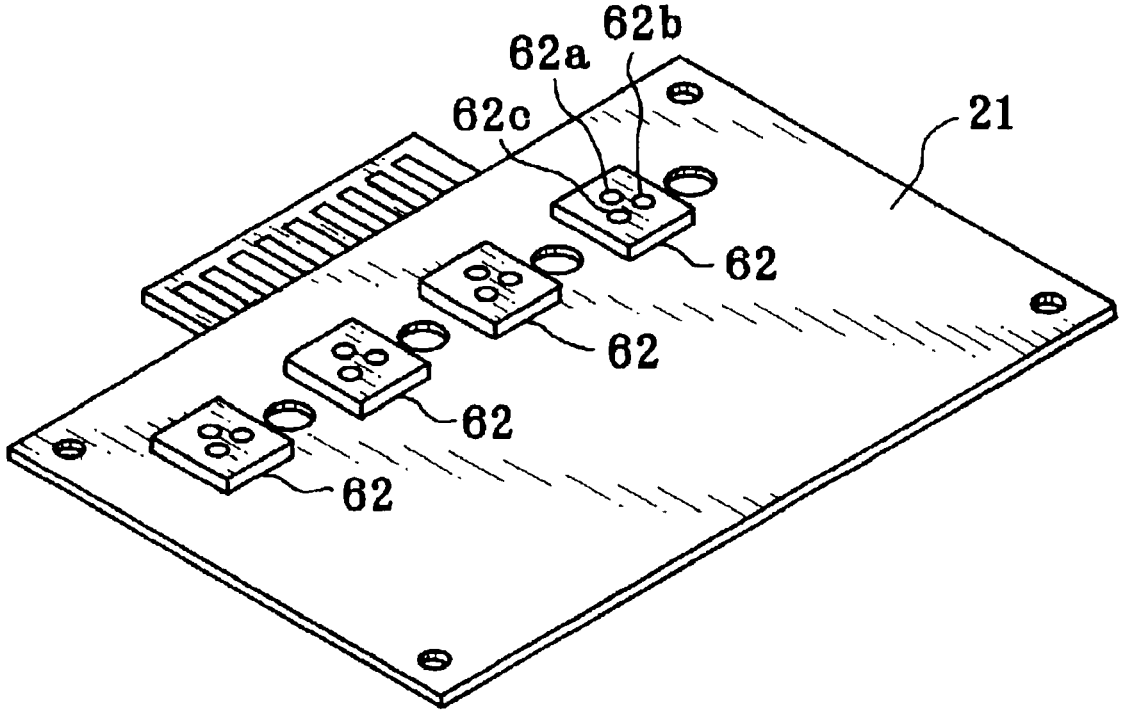
FIG. 8 is a perspective illustrating three illuminating surfaces for the three colors are associated with each one of the light emitting diodes.

In FIG. 8, another preferred embodiment is illustrated, in which each of chips of LEDs (light emitting diodes) 62 as light emitting elements has a red illuminating surface 62*a*, a green illuminating surface 62*b* and a blue illuminating surface 62*c*. Except for the LEDs 62, elements similar to those in the above embodiments are designated with identical reference numerals. Light beams or spotted lights output by the illuminating surfaces 62*a*–62*c* are mixed by the first and second prism element groups 25 and 26, and then are applied to the photo film. As a result, the latent image 15*a* can be formed in the full-color recording.

Figure 9:
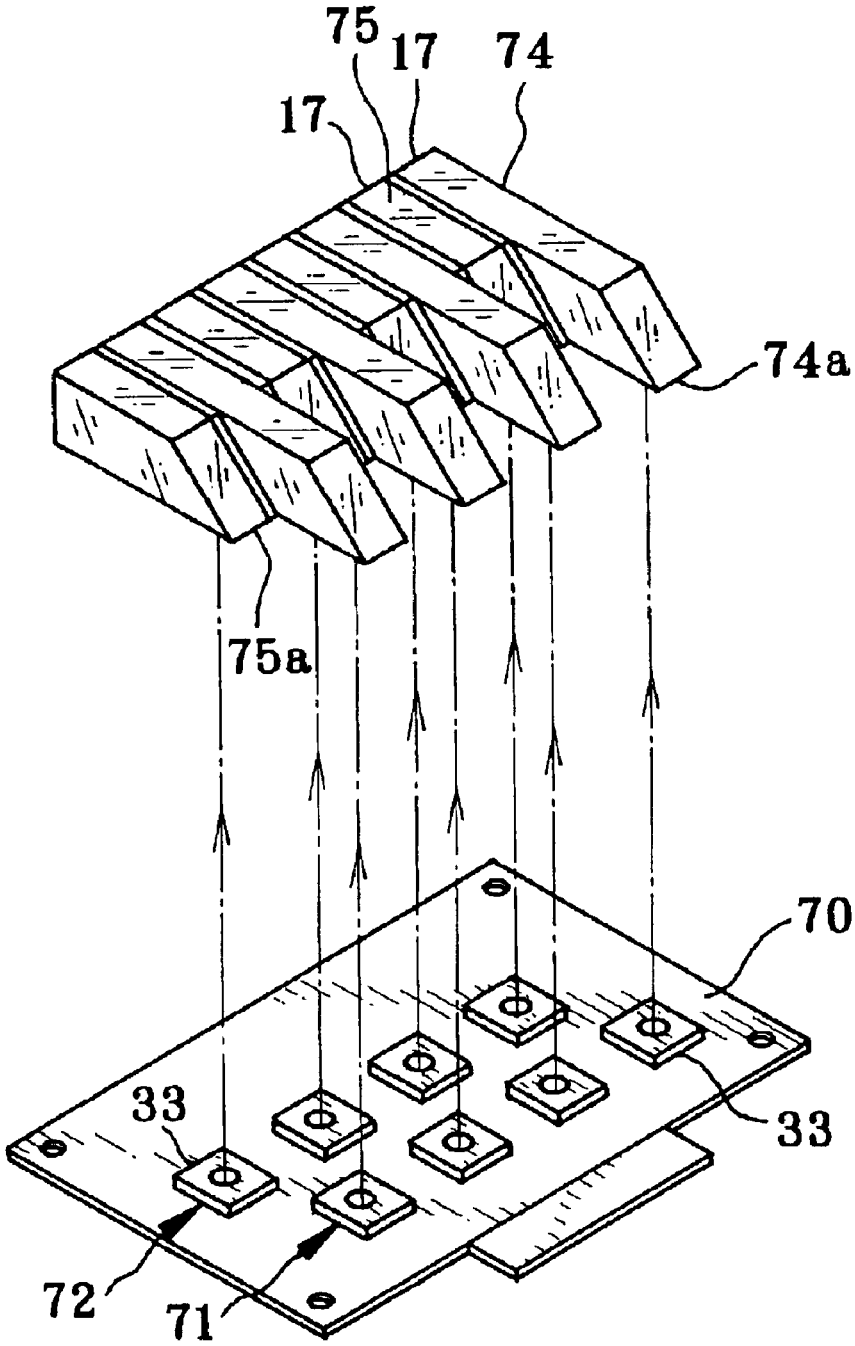
FIG. 9 is an exploded perspective illustrating a preferred embodiment in which LEDs are arranged in a zigzag manner on one board.

In FIG. 9, another preferred embodiment is depicted, in which LED chips are disposed in a zigzag manner. Elements similar to those in the above embodiment are designated with identical reference numerals.

In the light emitting array unit, a light emitting array board 70 is provided with a first light emitting element array 71 and a second light emitting element array 72 both including the LEDs 33. The LEDs 33 in the first light emitting element array 71 are offset from those in the second light emitting element array 72 by an amount equal to the width of one LED in the direction of the extension of the arrays.

A first prism element group 74 as first light path changer has an entrance surface 74*a*, which is opposed to the LEDs 33 of the first light emitting element array 71. The first prism element group 74 bends a light path of light from the LEDs 33, and causes the light to exit through the exit surfaces 17. A second prism element group 75 as second light path changer has such a size that an interval between an inclined reflection surface and the exit surfaces 17 is smaller than that of the first prism element group 74. An entrance surface 75*a* of the second prism element group 75 is opposed to the LEDs 33 of the second light emitting element array 72. The exit surfaces 17 of the second prism element group 75 are aligned with those of the exit surfaces 17 of the first prism element group 74. A light path of light from the LEDs 33 in the second light emitting element array 72 is bent by the second prism element group 75 to output the light through the exit surfaces 17.

Light beams or spotted lights output from the LEDs 33 on the light emitting array board 70 in a zigzag manner enter the first and second prism element groups 74 and 75, are bent by 90 degrees, and are output as a single array of beams. A difference between lengths of light paths through the first and second prism element groups 74 and 75 is negligible. Thus, it is unnecessary to set changes in the timing of driving the LEDs 33 between the light emitting element arrays 71 and 72 for the purpose of exposing one line. Note that the LEDs 33 may be arranged in three or more arrays instead of the two arrays in the present embodiment.

Note that the LED chips are used as light emitting elements. However, other types of light emitting elements may be used. Instead of the prisms, other structures for bending light paths may be used, for example mirrors, half mirror. Furthermore, a light emitting array unit of the invention may be used in an optical printer in which a photosensitive drum can be exposed to record lines by use of light emitted in the linear shape.

In the above embodiments, the light paths are bent by the reflection. Alternatively, the light paths may be bent by methods other than the reflection.

Also, a light emitting array unit of the invention may be used as linear light source for various uses, for example, indoor illumination of a decorative type.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A light emitting array unit for emitting line-shaped light constituted by plural spotted lights arranged in a line, comprising:

N light emitting element arrays disposed substantially in parallel with one another, each of said light emitting element arrays including plural light emitting elements arranged linearly in a first direction and at a pitch P, said light emitting elements being offset between said light emitting element arrays in said first direction by P/N; and a light guide means for guiding light emitted by respectively said light emitting elements; to create said line-shaped light, wherein said N light emitting element arrays include first and second light emitting arrays, and one light emitting element included in said second light emitting array is positioned on a straight extension line that passes a central point between two adjacent light emitting elements included in said first light emitting array, and said light guide means includes plural prism elements associated with respectively said light emitting elements, each of said prism elements is in a prismatic shape, and includes an inclined surface at one end with an inclination of half a right angle, and a perpendicular surface at a remaining end;

said inclined surface is disposed on a straight line extending from an associated one of said light emitting elements, and reflects said light being incident thereon toward said perpendicular surface;

said perpendicular surface of said prism elements is aligned in a flush manner, and causes said light to exit from said prism elements by way of said spotted lights according to said light emitting elements.

2. A light emitting array unit as defined in claim 1, further comprising an optical system for projecting said line-shaped light on to photo film being fed, to record a letter, number or indicia to said photo film photographically.

3. A light emitting array unit as defined in claim 1, further comprising plural blocking partitions, disposed between said prism elements and alternately therewith, for shielding light.

4. A light emitting array unit as defined in claim 1, wherein each of said light emitting elements includes three regions for emitting light of three primary colors.

5. A light emitting array unit as defined in claim 1, further comprising one board for supporting said first and second light emitting element arrays mounted thereon substantially in parallel with one another in a flush manner.

6. A light emitting array unit as defined in claim 1, further comprising first and second boards disposed substantially in parallel with each other, said first light emitting element array being mounted on said first board, said second light emitting element array being mounted on said second board, and opposed to said first light emitting element array.

7. A light emitting array unit for emitting line-shaped light constituted by plural spotted lights arranged in a line, comprising:

first and second boards disposed substantially in parallel with each other;

a first light emitting element array mounted on said first board, including plural light emitting elements arranged linearly in a first direction at a pitch P;

a second light emitting element array mounted on said second board, including plural light emitting elements arranged linearly in said first direction at said pitch P, said second light emitting element array being opposed to said first light emitting element array, wherein one light emitting element included in said second light emitting array is positioned on a straight extension line that passes a central point between two adjacent light emitting elements included in said first light emitting array;

a first light guide group disposed between said first and second boards, including plural light guides each of which guides said light from said light emitting elements of said first light emitting element array toward an exit end; and a second light guide group disposed between said first and second boards, including plural light guides each of which guides said light from said light emitting elements of said second light emitting element array toward an exit end, wherein said light guides in said first light guide group are arranged alternately with said light guides in said second light guide group, and said exit ends of said light guides are aligned on a line to create said line-shaped light.

8. A light emitting array unit as defined in claim 7, wherein said light guides include plural prism elements, each of said prism elements is in a prismatic shape, and includes an inclined surface at one end with an inclination of half a right angle, and a perpendicular surface at each of said exit ends that is a remaining end;

said inclined surface is disposed on a straight line extending from an associated one of said light emitting elements, and reflects said light being incident thereon toward said perpendicular surface, and causes said light to exit by way of said spotted light.

9. A light emitting array unit as defined in claim 8, further comprising plural blocking partitions, disposed between said prism elements and alternately therewith, for shielding light.

10. A light emitting array unit as defined in claim 9, further comprising:

plural openings, formed in said first and second boards, arranged linearly, for passing said light emitted by said light emitting elements and transmitted through said inclined surface;

plural photo sensors for receiving said light emitted by said light emitting elements and passed through said openings, for measuring intensity of light emission of said light emitting elements.

11. A light emitting array unit as defined in claim 7, wherein said first and second light guide groups respectively guide light emitted from said light emitting elements of said first and second light emitting element arrays in a direction substantially perpendicular to a direction of the light emitted by each of the emitting elements of said first and second light emitting element arrays.

12. A side printing device comprising:

a red light emitting array unit for emitting line-shaped light constituted by plural red spotted lights arranged in a line;

a green light emitting array unit for emitting line-shaped light constituted by plural green spotted lights arranged in a line;

a blue light emitting array unit for emitting line-shaped light constituted by plural blue spotted lights arranged in a line; and an optical system for combining said line-shaped light of three colors, to record a letter, number or indicia photographically in a full-color manner to a side portion of photo film being fed;

each of said red, green and blue light emitting array units including:

A. N light emitting element arrays disposed substantially in parallel with one another, each of said light emitting element arrays including plural light emitting elements arranged linearly in a first direction and at a pitch P, said light emitting elements being offset between said light emitting element arrays in said first direction by P/N; and B. a light guide means for guiding light emitted by respectively said light emitting elements, to create said line-shaped light wherein said N light emitting element arrays include first and second light emitting arrays, and one light emitting element included in said second light emitting array is positioned on a straight extension line that passes a central point between two adjacent light emitting elements included in said first light emitting array, wherein said light guide means includes plural prism elements associated with respectively said light emitting elements, each of said prism elements is in a prismatic shape, and includes an inclined surface at one end with an inclination of half a right angle, and a perpendicular surface at a remaining end;

said inclined surface is disposed on a straight line extending from an associated one of said light emitting elements, and reflects said light being incident thereon toward said perpendicular surface;

said perpendicular surface of said prism elements is aligned in a flush manner, and causes said light to exit from said prism elements by way of said spotted lights according to said light emitting elements.

13. A side printing device as defined in claim 12, further comprising plural blocking partitions, disposed between said prism elements and alternately therewith, for shielding light.

14. A side printing device as defined in claim 13, wherein said optical system includes two dichroic mirrors for combining said line-shaped light of said three colors, and a lens for projecting said line-shaped light of said three colors being combined on to said photo film.

15. A side printing device as defined in claim 13, wherein said optical system includes three lenses for projecting respectively said line-shaped light of said three colors, to combine said three colors of said line-shaped light on to said photo film.

* * * * *